US006155187A

United States Patent [19]

Bennett et al.

[11] Patent Number: 6,155,187

[45] Date of Patent: Dec. 5, 2000

[54] TUFTING OF LEVEL CUT PILE AND LOOP PILE IN THE SAME ROW OF STITCHING

[75] Inventors: Neale Kenneth Bennett; Alan Reid, both of Blackburn, United Kingdom

[73] Assignee: Spencer Wright Industries, Inc., Dalton, Ga.

[21] Appl. No.: 09/489,056

[22] Filed: Jan. 21, 2000

[51] Int. Cl.[7] ..... D05C 15/16

[52] U.S. Cl. ..... 112/80.51

[58] Field of Search ..... 112/80.04, 80.55, 112/80.56–80.71, 292, 295, 298, 80.51

[56] References Cited

U.S. PATENT DOCUMENTS 3,812,799 5/1974 Spanel et al. ..... 112/80.55 X
4,134,347 1/1979 Jolley et al. ..... 112/80.51
4,185,569 1/1980 Inman ..... 112/80.51
4,353,317 10/1982 Crumbliss ..... 112/80.51
4,466,366 8/1984 Hirotsu ..... 112/80.56

*Primary Examiner*—Ismael Izaguirre
*Attorney, Agent, or Firm*—Alan Ruderman; Stephen J. Stark

[57] ABSTRACT

A multi-cylinder module has a common block within which the cylinders are formed and having a piston disposed within each cylinder and an output rod connected to each piston. Pressurized air acts on the piston against the bias of a corresponding spring to drive the respective rod outwardly from the module. Each rod has a coupling member which is coupled to the gate of a hook of a tufting machine having gated hooks for forming both loop and cut pile. The modules are mounted directly to the hook bar of the tufting machine and require no additional linkages between the coupling and the gate with the inherent lost motion and other inefficiencies associated with such additional linkages.

9 Claims, 2 Drawing Sheets

TUFTING OF LEVEL CUT PILE AND LOOP PILE IN THE SAME ROW OF STITCHING

BACKGROUND OF THE INVENTION

This invention relates to tufting machines and more particularly to a method and apparatus for selectively forming cut pile and loop pile having substantially the same pile height as the cut pile in the same row of stitching in a backing material.

In Jolley, et al., U.S. Pat. No. 4,134,347 and Inman, U.S. Pat. No. 4,185,569, a method and apparatus for forming cut pile and loop pile are substantially the same pile height in the same row of stitching is disclosed. These patents represent improvement over Card, U.S. Pat. No. 3,084,645 wherein the cut pile projects substantially further from the backing than the loop pile and thus the pile height differs substantially. In McCutchen, U.S. Pat. Nos. 2,879,728 and 2,879,729, prior attempts to provide level cut and loop pile were made without success. The inventions in the aforesaid Jolley, et al., and Inman patents have been and remain very successful. This is especially true of variations of the sliding gate structure of the second embodiment illustrated in FIGS. 7–11 in the Inman patent wherein the gate slides and cooperates with the bill of the hook to open or close passage of a seized loop from the bill to the blade selectively. Those loops released from the bill remain uncut of those loops which pass to the closed end of the hook are cut.

One of the problems with the sliding gate structure which does not occur with a pivoted gate as in Jolley, et al., and the first embodiment in Inman wherein the gate pivots on the hook is that since there is lateral movement, vertical support must be provided to the gate driving mechanism. In the second embodiment of Inman and variations of this in the prior art, there must be an extension connected to the sliding gate or to the equivalent such as a sliding cut/loop clip. In Inman, which for practical reasons was not reduced to practice, this comprised a slide block supported on a fixed member of the tufting machine but in apparatus constructed in the prior art, this comprised of an extension member between the gate and the driving air cylinders which move with the hook bar as the hook rocks or oscillates. These extension members had to be supported on a member fastened to and movable with the hook backing bar and the cylinder support.

The additional linkages between the gate or clip and the air cylinder results in lost motion inefficiencies and wear problems. Moreover, the extra weight associated with the linkage, its supports, and the air cylinders moving with the hooks obviously creates undesirable momentum and inertia forces. Another problem with the prior art structure is that assembly of each separate cylinder to its link and to the gate is time consuming. This also results in additional maintenance costs due to replacement of cylinders or gates that fail or break during normal operation.

SUMMARY OF THE INVENTION

Consequently, it is a primary object of the present invention to provide a sliding gate structure for a tufting machine which is relatively light in weight and which has substantially no lost motion between the gate and the output rod of a driving cylinder.

It is another object of the present invention to provide a mounting of the hooks and cylinders of a sliding gate tufting machine performing cut pile and loop pile in the same row of stitching at substantially the same height, the hooks and cylinders which drive the gate being mounted on the same backing bar of the tufting machine, the mounting having no linkages between the cylinder output rods and the gates.

It is a further object of the present invention to provide mounting apparatus for mounting the gated hooks of a level cut and loop tufting machine and the driving cylinders which provide ease of assembly and maintenance.

It is a yet still further object of the present invention to provide a cylinder module having a plurality of output drive rods for driving an equal number of gates for a substantially level cut and loop pile tufting machine.

Accordingly, the present invention provides a module comprising a common block carrying a plurality of pneumatic cylinders and having securing members for connecting to the common backing bar to which the hook module of a level cut and loop tufting machine is mounted, the output rods of the cylinders having respective coupling members to which the gates of the hooks are coupled. The modules permit elimination of the linkages required in the prior art and permit the cylinders and hooks to be carried by a single backing bar thereby eliminating the need for a bar for mounting the hooks, a separate bar for mounting the cylinders and a separate bar for mounting the linkages which must be connected together and forms a relatively heavy oscillating structure. Moreover, when assembling the structure of the present invention the plurality of cylinders are mounted as a unit thereby reducing assembly time and cost and minimizing down-time during maintenance. The elimination of the intermediate linkages required in the prior art also substantially eliminates the lost motion inefficiencies associated therewith.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
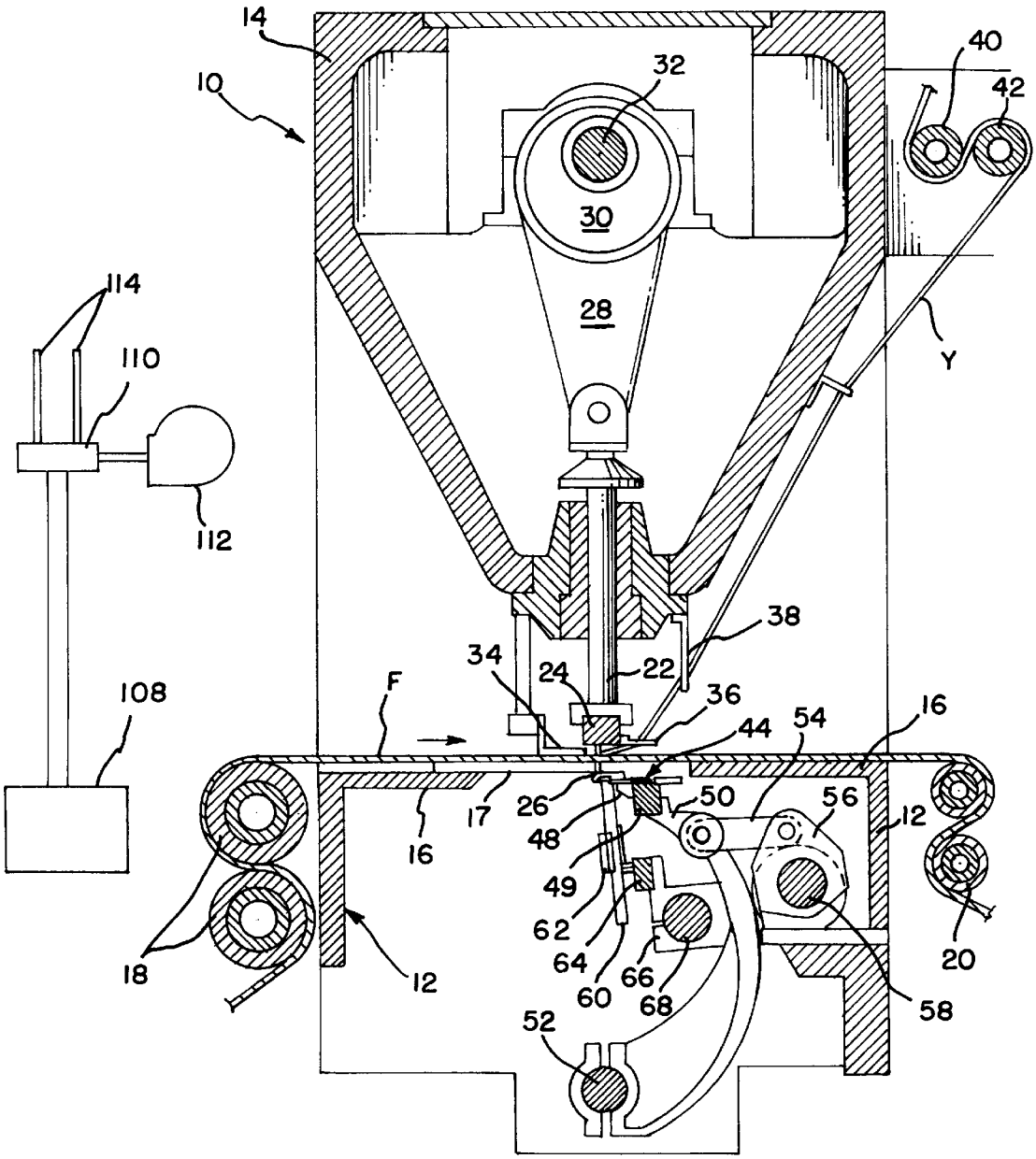
FIG. 1 is a vertical sectional view taken transversely through a multiple needle tufting machine to incorporating apparatus constructed in accordance with the principles of the present invention and illustrating certain features in diagrammatic form.

Referring now to the drawing, FIG. 1 illustrates apparatus constructed in accordance with the present invention incorporated in a tufting machine 10 having a frame comprising a bed 12 and a head 14 disposed above the bed. The bed 12 includes a bed plate 16 having a support finger plate 17 across which fabric F is adapted to be fed in the direction illustrated by a pair of input feed rolls 18 and output or take-off rolls 20.

Mounted in the head for vertical reciprocation is one of a plurality of push rods 22 to the lower end of which a needle bar 24 is carried and which in turn carries a plurality of needles 26 which are adapted to penetrate the fabric F through fingers in the support finger plate 17 upon reciprocation of the needle bar 24 to project loops of yarn therethrough. Endwise reciprocation is imparted to the push rods 22 and thus the needle bar 24 and needles 26 by a connecting rod 28 which is pivotally connected at its lower end to the push rods 22 and at its upper end to an eccentric 30 on a driven rotary main shaft 32 that is journaled longitudinally in the head 14. A pressure foot assembly 34 may be supported on the head 14 to hold down the fabric F during needle retraction. A yarn-jerker 36 is carried by the needle bar 24 and operates to engage the yarn between a stationary yarn guide 38 on frame of the machine and the needles 26.

Yarn Y is supplied to each needle 26 by a conventional type of yarn feed mechanism including a pair of feed rolls 40, 42 may be mounted on the head 14 adapted to be continuously rotated by any convenient means preferably synchronized with the main shaft 32 to continuously feed lengths of yarn to the needles. For reasons which should be apparent, the amount of yarn fed to the needles is less than that demanded by the system so that yarn is pulled back from each loop after it has been formed as each stitch is tightened and set into the fabric F.

Mounted within the bed for cooperation with the needles to seize loops of yarn presented thereto are a plurality of loopers or gated hooks generally indicated at 44 and as hereinafter described in conjunction with FIG. 3. The hooks as hereinafter made clear are of the cut pile type which point in the direction opposite to that which the fabric is fed, and additionally carry a sliding gate as hereinafter described. The hooks preferably are mounted in modules 48 similar to those modules disclosed in Bardsley, U.S. Pat. No. 4,739,717 which are connected to a mounting bar 49 secured to the upper end of a rocker arm 50. Any conventional means to oscillate the arm 50 may be provided. It is preferred that the lower end of the rocker arm 50 is clamped to a laterally extending rocker shaft 52 journaled in the bed. Pivotally connected to the upper portion of the rocker arm 50 is one end of the connecting link 54 having its other end pivotally connected between forked arms of a jack shaft rocker arm 56. The arm 56 is clamped to a jack shaft 58 which has oscillating motion imparted thereto by a conventional drive means such as a cam and lever means (not shown) from the main shaft 32 in timed relationship with the reciprocation of the needles.

The tufting machine incorporates a plurality of knives 60 which may cooperate with the hooks that cut the selected loops thereon to form cut pile as hereinafter described. The knives may be mounted in knife blocks 62 secured to a knife bar 64 which in turn is secured to a knife shaft rocker arm 66 clamped to a knife shaft 68 to conventionally drive the knives into engagement with one side of the respective hooks as known in the art to provide a scissors-like cutting action.

Figure 2:
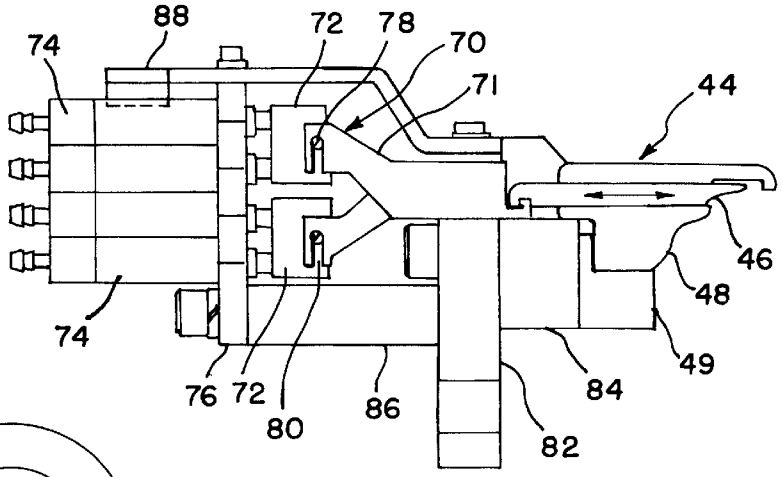
FIG. 2 PRIOR ART
FIG. 2 is a fragmentary vertical sectional view of a portion of a tufting machine illustrating the prior art hook and gate mounting structure.

As illustrated in FIG. 2, in the prior art the gated hooks 44 and the associated modules 48 within which a plurality of hooks are mounted have the gate 46 slidably mounted within a slot formed in the hook to open and close the bill of the hook, the tail of the gate being connected through a linkage 70 including a link 71 and a block fastened to the output rod of the respective pneumatic cylinder 74. Due to space limitations, the cylinders were mounted in a vertical stack with the cylinder 74 supported in a frame 76 and the blocks 72 of adjacent cylinders offset vertically so that a coupling pin 78 on each block may cooperate with a slot 80 in the cooperating end of a respective link 71, the links of alternate hooks 44 differing so that the block connecting portions of alternate links are spaced not only laterally but vertically as illustrated.

The hook mounting bar 49 must be connected to a support member 82 by means of a spacer member 84 therebetween and is in turn connected to the cylinder support frame 76 by another spacer member 86. A cover member 88, which is required to protect the apparatus from lint due to the environment in which it operates is connected to the support member 82 and to the frame 76. Although the elements illustrated in FIG. 2 oscillate with the hook mounting bar drive as aforesaid. Thus, it may be readily understood that since all of these elements are constructed from steel, a very heavy mass must be oscillated, and also the multitude of elements require substantial assembly time during manufacture and both disassembly and assembly time during maintenance.

Figure 4:
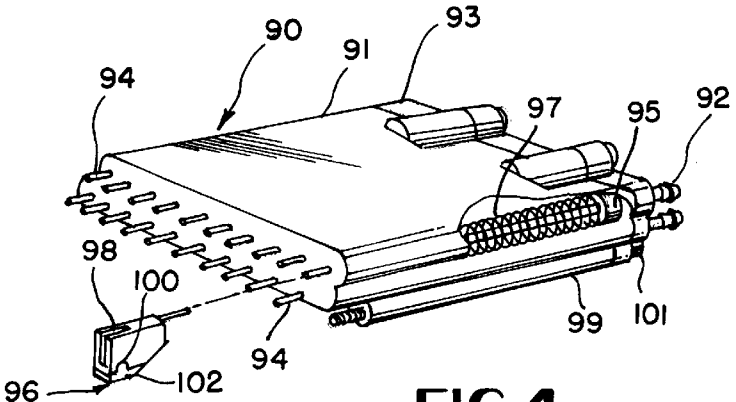
FIG. 4 is a perspective view of a cylinder module partly broken away constructed in accordance with the principles of the present invention and illustrating one coupling member exploded out from the module.
Figure 3:
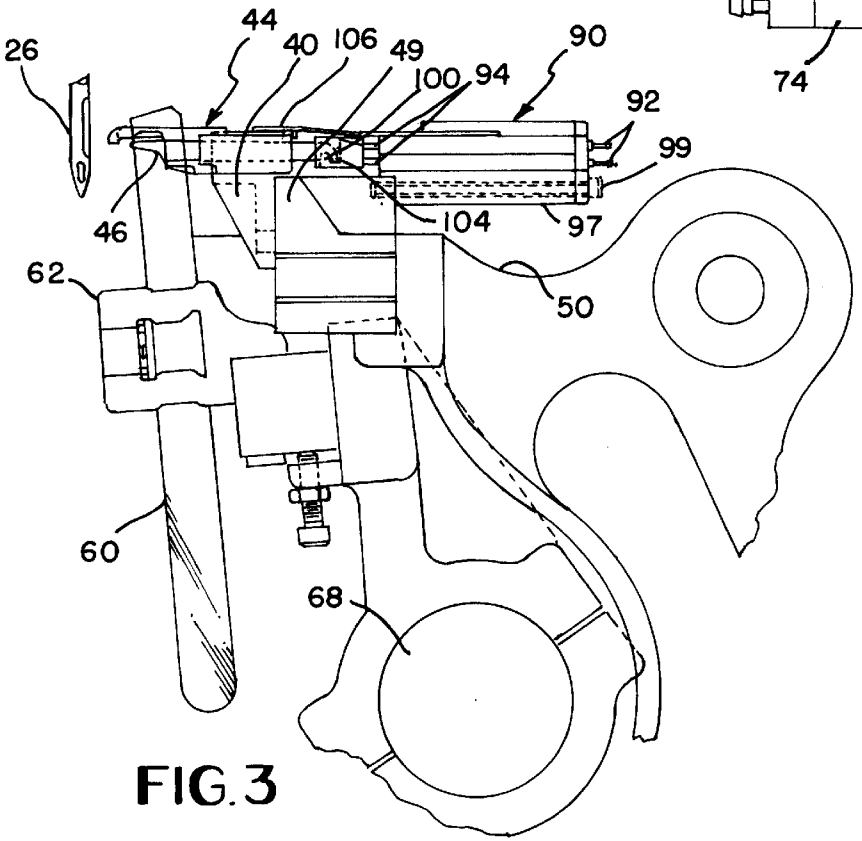
FIG. 3 is a fragmentary vertical sectional view of a portion of the tufting machine illustrated in FIG. 1, but enlarged to show the hook and gate mounting structure constructed in accordance with the present invention.

To overcome these disadvantages of the prior art, the present invention provides a cylinder module 90 illustrated in FIGS. 3 and 4, the module comprising a housing constructed from two body members 91, 93 formed from aluminum alloy so as to be light in weight and carrying a plurality of pneumatic cylinders (not illustrated) fed with air from respective nipples 92 and having piston driven output rods 94. The body member 91 has cylindrical chambers formed therein and receives the pistons 95 with the rods extending out the end remote from the body member 93, the latter having the input nipples 92. A spring 97 biases the rods inwardly. The cylinders and thus the output rods 94 are arranged in two vertical spaced apart rows with the cylinders in one row staggered relative to those in the other row so that coupling members 96 may be attached to each rod and provide clearance for extending freely. In a preferred forms of the module there are twenty cylinders in an ⅛ gauge machine and twenty four cylinders in a 1/10 gauge machine and half of the cylinders are in each row. Disposed at each lateral end integral with the lower surface of the module is a respective tube 99 (only one of which is shown) within which a screw 101 extends for securing the module to the mounting bar 49.

Each of the coupling members 96 includes a slot 98 with an internal nub 100, the coupling being formed from two members, one of which being a small member 102 having the nub 100 formed thereon and fitted laterally into the main body of the member 96 in jigsaw fashion. The nub 100 is adapted to be received within and coupled with a complimentary recess formed in the tail end 104 of the gate 46 so that the gate may move with the cylinder rod of the respective cylinder. In the preferred embodiment, the cylinder rod extends when pressurized air is supplied to the corresponding cylinder and retracts into the cylinder by virtue of a spring internal to the cylinder when the pressure is released. A cover 106 preferably may overlie the module, the rods and the tail end of the gate for the same purpose as in the prior art.

As in known in the prior art when the gate is extended the hook is closed and the loop which has been seized is released to form loop pile, but when the gate is retracted the loop may enter the blade of the hook and move toward the throat at the closed end where it is cut by the knife 60 to form cut pile.

The control of the air cylinders and thus the gates may be via a programmed computer 108 supplying signals to valves 110, the number of valves; preferably corresponding to the cylinders so that each hook in the tufting machine is controlled individually, the valves opening and closing communication between a compressor 112 and air conduits 114 communicating the valves with the cylinders in the module. As understood by those skilled in the art, there will be a plurality of such modules across the tufting machine which may have some 1000 or more hooks cooperating with an equal number of needles.

Accordingly, a module and the mounting thereof is disclosed which is light weight and may be mounted on the hook backing bar without the need for additional linkages.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invent-ion. All such modifications which do not depart from the spirit of the invention are intended to be included within the scope of the appended claims.

Having thus set forth the nature of the invention, what is claimed herein is:

1. A cylinder module for a tufting machine comprising a housing formed with a plurality of internal spaced apart cylindrical chambers, each chamber having a piston located therein and having an output rod connected to the respective piston extending from the housing, an air inlet communicating with the respective chamber for receiving pressurized air selectively to drive said piston against an internal biasing force when pressurized air is supplied through the inlet, and said housing having an integral connecting portion for receiving a connecting member for attachment to said tufting machine.

2. A cylinder module as recited in claim 1, wherein said connecting portion comprises a tube integral with said housing for receiving a connecting member for connecting to said tufting machine.

3. A cylinder module as recited in claim 1, wherein said rods are driven outwardly by pressurized air and are biased inwardly.

4. A module for a tufting machine including a plurality of hooks fastened to an oscillating hook bar, each hook having a bill and a throat with a blade therebetween, a gate oscillating with and moveable relative to each respective hook to permit loops of yarn to be released selectively from the bill or to be received onto the blade and pass to the throat, a knife driven into cooperation with each hook for severing loops of yarn that have moved to the throat, said module comprising a housing formed with a plurality of internal spaced apart cylindrical chambers, each chamber having a piston located therein and having an output rod connected to the respective piston and extending from the housing, an air inlet communicating with the respective chamber for receiving pressurized air selectively to drive said piston against an internal biasing force when pressurized air is supplied through the inlet, said housing having a connecting portion for receiving a connecting member for attachment to said hook bar, and a coupling member fastened to each output rod and to a respective gate for connecting said rod to said respective gate.

5. A module as recited in claim 4, wherein said connecting portion comprises a tube integral with said housing and receiving a threaded connecting member for attachment to said hook bar.

6. A module as recited in claim 4, wherein said rods are driven outwardly by pressurized air and are biased inwardly.

7. In a tufting machine as recited in claim 5, wherein said connecting portion of said module comprises a tube integral with said housing for receiving a threaded connecting member for attachment to said hook bar.

8. In a tufting machine comprising a plurality of hooks fastened to an oscillating hook bar, each hook having a bill and a throat with a blade therebetween, a gate oscillating with and moveable relative to each hook to permit loops of yarn to be released selectively from the bill or to be received onto the blade and passed to the throat, a knife driven into cooperation with each hook for severing loops of yarn thereon that have moved to the throat, a cylinder module including a housing formed with a plurality of air internal spaced apart cylindrical chambers, each chamber having a piston located therein and having an output rod connected to the respective piston and extending from the housing, an air inlet communicating with the respective chamber for receiving pressurized air selectively to drive said piston against an internal biasing force when pressurized air is supplied through the inlet, said housing having a connecting portion for receiving a connecting member for attachment to said hook bar, and a coupling member fastened to each output rod and to a respective gate for connecting each rod to said respective gate.

9. In a tufting machine as recited in claim 7, wherein said rods are driven outwardly by pressurized air and are biased inwardly.

* * * * *